US005787231A

United States Patent [19]

Johnson et al.

[11] Patent Number: 5,787,231

[45] Date of Patent: Jul. 28, 1998

[54] METHOD AND SYSTEM FOR IMPROVING PRONUNCIATION IN A VOICE CONTROL SYSTEM

[75] Inventors: William Johnson, Flower Mond; Owen Weber, Coppell, both of Tex.

[73] Assignee: International Business Machines Corporation

[21] Appl. No.: 382,737

[22] Filed: Feb. 2, 1995

[51] Int. Cl.[6] ..... G10L 5/02

[52] U.S. Cl. ..... 395/2.69; 395/2.84

[58] Field of Search ..... 395/2.69, 2.84

[56] References Cited

U.S. PATENT DOCUMENTS

| | | | |
|---|---|---|---|
| 4,509,133 | 4/1985 | Monbaron et al. | 364/513.5 |
| 4,523,055 | 6/1985 | Hohl et al. | 179/2 DP |
| 4,779,209 | 10/1988 | Stapleford et al. | 364/513.5 |
| 4,831,654 | 5/1989 | Dick | 381/51 |
| 4,841,574 | 6/1989 | Pham et al. | 381/31 |
| 4,979,216 | 12/1990 | Malsheen | 381/52 |
| 5,040,218 | 8/1991 | Vitale et al. | 381/52 |
| 5,157,759 | 10/1992 | Bachenko | 395/2 |
| 5,204,905 | 4/1993 | Mitome | 381/52 |
| 5,231,670 | 7/1993 | Goldhor et al. | 381/43 |
| 5,305,205 | 4/1994 | Weber et al. | 364/419.1 |
| 5,384,893 | 1/1995 | Hutchins | 395/2.76 |

OTHER PUBLICATIONS

Furi, "Advances in Speech Signal Processing," Marcel Dekker, Inc., New York, New York, 818–19, 1992.

*Primary Examiner*—Allen R. MacDonald
*Assistant Examiner*—Robert C. Mattson
*Attorney, Agent, or Firm*—Gunn & Associates, P.C.

[57] ABSTRACT

A voice enunciation system and method provides a user with the capability to sound out text files. As the files are audibly played, if the user is not satisfied with the pronunciation of a particular word, the system provides the user with the means of replacing the word with his own particular pronunciation. The preferred pronunciation is also stored in an override dictionary so that any subsequent encounter with that particular word is pronounced correctly.

26 Claims, 4 Drawing Sheets

METHOD AND SYSTEM FOR IMPROVING PRONUNCIATION IN A VOICE CONTROL SYSTEM

FIELD OF THE INVENTION

The present invention relates generally to the field of voice control systems and, more particularly, to a system and method of improving pronunciation in a voice control system. The present invention further comprises a user developed overriding dictionary for a voice control system.

BACKGROUND OF THE INVENTION

Voice control systems, which support voice enunciation systems, often use a phonetic approach to sounding words. Using phonetics to sound words may produce undesirable results. That is, a word may not be pronounced as a user prefers it to be pronounced. For example, the popular operating system, OS/2 (properly pronounced "oh ess two"), may be phonetically pronounced "oz two". A method is therefore needed for enhancing a phonetic pronunciation so that awkwardly or improperly pronounced words are pronounced in a manner preferred by the user.

In an enunciation system, which uses a word dictionary to pronounce words, problems also arise when the words are not recognized because they are conglomerations of characters (e.g. PGMXYZ.EXE) with a meaning known only to the creator of the character string. A method is therefore needed for communicating the desirable pronunciation for such an occurrence.

Known systems, primarily coupled to a computer through a serial or parallel interface, generate sound from a text string. Such known systems phonetically generate a series of sounds that obey a set of phonetic rules. However, as previously explained, the English language (and others as well) does not always rigidly obey these phonetic rules.

Other known systems permit a user to insert a sound file, i.e., a digitized audio signal (referred to herein as a "wave file"), within a word processing document. For example, the Microsoft Word word processing program permits a user to insert what is referred to as a voice pronunciation command into a text file. However, this command is no more than inserting a binary representation of a wave file at a specified location of a text.

A wave file is a binary, i. e. digital, file of a recorded analog signal, generally saved as a WAV extension. Some modern operating systems today come with a set of stock WAV files. Such stock WAV files follow a standardized format for playing an audio signal.

However, such systems currently do not provide an interface to a phonetic pronunciation system to sound out text files. Thus, there remains a need for a system that can provide a playback of a text file in such a way that is transparent to a user.

Further, there is also a need in such a seamless system for an overriding dictionary that remembers certain text strings that have been encountered by a user before and properly pronounced. In this way, as a text file is being processed, the user need only stop the processing once to correct such a text string. The next time that such a string is encountered, the overriding dictionary will automatically develop the correct series of sounds with use of a wave file. Such a system should also provide a queue for storing work in process so that a smooth playback, without hesitation in the production of a system, is provided.

Such a system should also be capable of capturing text from a variety of sources for ease of use. For example, the user should have the option of highlighting text on a screen to capture text and he should also be provided with the capability of importing text from other workstations coupled to a network or otherwise in communication with the users station.

SUMMARY OF THE INVENTION

The present invention provides such a voice enunciation system. The system accepts text from sources such as files, windows, or the like and permits a user to direct a specific pronunciation without regard to the source of the text.

The present invention allows a user to interrupt an enunciation system with a voice command. The user may then voice a word for recognition which will be dictated for all subsequent occurrences. Upon system interrupt with a voice command such as "STOP", the system annotates words in reverse until the user voice commands another directive such as "YES" or the like. This indicates to the system that the currently selected word is to be replaced. Therefore, another aspect of the present invention is an integration of voice recognition with voice enunciation in order to improve voice pronunciation.

Upon detection of the "YES" directive, the system again flags the suspect word and prompts the user for replacement.

The user may issue a command such as "OK" if the word is acceptable as pronounced. The user will voice a desirable pronunciation of the word and the system will ensure it is understood by repeating it. If the user is satisfied with the system voice of the word, the user again issues a directive such as "OK" to continue the process. The desirable pronunciation is preferrably saved as a wave file. If the user is not happy with the system pronunciation again, a directive such as "NO" may be issued to have the system prompt the user for another input pronunciation.

The user need not pronounce the word anything like it is spelled. The system will convert the user input into a form which can be later recalled and pronounced exactly as the user desires it. Updated pronounced words are stored in an enunciation dictionary which is consulted with a lookahead thread of execution so the process is prepared to voice the correct word upon encounter of it.

The present invention is equally applicable to commands from a keyboard, mouse, or the like during the process.

In addition to the dictionary file, the present invention provides for a work queue and a playback queue. The work queue provides a reservoir of word entries so that the sounding (audible play) of words during a play thread is smooth and uninterrupted. The playback queue provides a reservoir for last-in-first-out audible play of immediately-past words during the play thread. This way, a user can selectively work his way back to a previously sounded word to correct or modify a word.

In one aspect, the present invention comprises a method in a data processing system for enhancing voice processing of a textual input stream. This method comprises the steps of receiving text from the textual input stream, comparing the text with a customizable processing dictionary (which may also be referred to herein as an overriding dictionary), determining a sound interface input in accordance with one of a plurality of playing methods for playing sound associated with the text (such as phonetically pronouncing a text file or audibly playing a wave file), and routing the sound interface input to an appropriate device interface in accordance with the one of a plurality of playing methods.

These and other objects an features of the present invention will be apparent to those of skill in the art from a brief review of the following detailed description in view of the accompanying drawing figures.

BRIEF DESCRIPTION OF THE DRAWINGS

For a more complete understanding of the present invention and the features and advantages thereof, reference is now made to the Detailed Description in conjunction with the attached Drawings, in which.

DETAILED DESCRIPTION OF A PREFERRED EMBODIMENT

Figure 1:
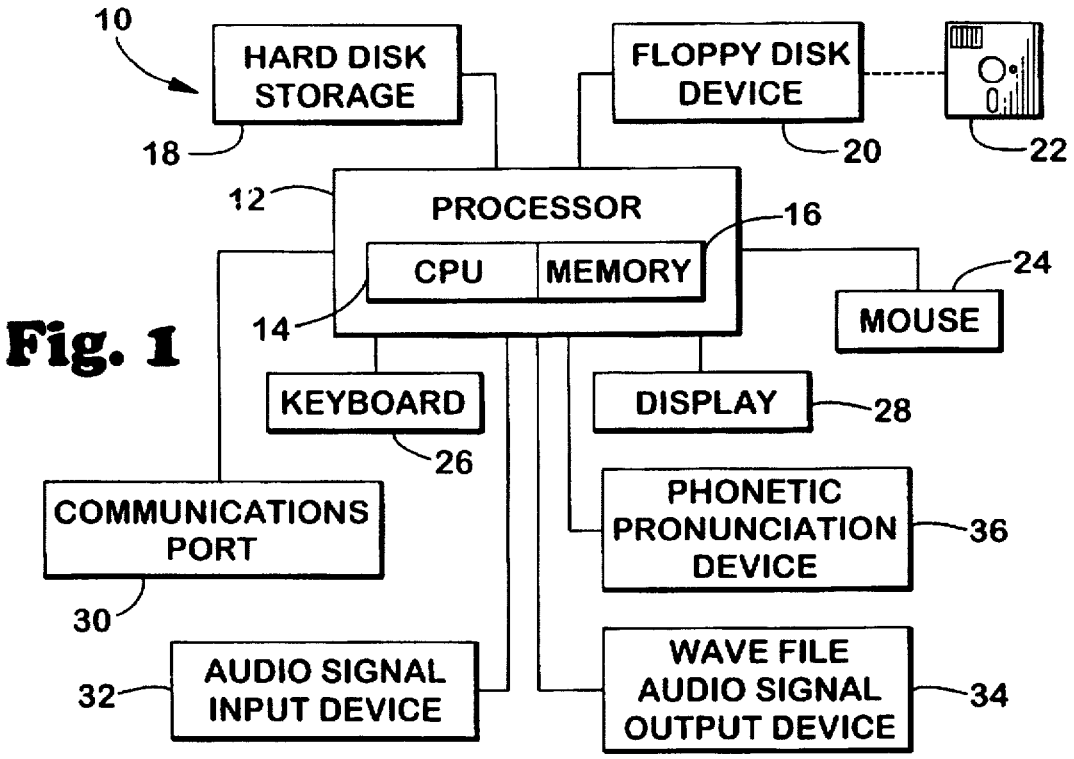
FIG. 1 is a block diagram of a general data processing system in which the present invention may find application.

FIG. 1 depicts a block diagram of a data processing system 10 in which the present invention finds useful application. The data processing system 10 includes a processor 12, which includes a central processing unit (CPU) 14 and a memory 16. Additional memory, in the form of a hard disk file storage 18 and a floppy disk device 20, is connected to the processor 12. Floppy disk device 20 receives a diskette 22 which has computer program code recorded thereon that implements the present invention in the data processing system 10.

The data processing system 10 may include user interface hardware, including a mouse 24 and a keyboard 26 to allow a user access to the processor 12 and a display 28 for presenting visual data to the user. The data processing system 10 may also include a communications port 30 for communicating with a network or other data processing systems. The data processing system 10 may also include audio signal devices, including an audio signal input device 32 for entering analog signals into the data processing system 10, an audio signal output device 34 for reproducing analog signals from wave files, and an audio signal output device 36 for reproducing audio signals from text strings. Audio signal output devices 34 and 36 are preferably packaged as the same hardware device.

As used herein, the term "interface" refers to any means of communication between any devices in the system. Thus, an interface is broadly applicable to software interfaces and hardware interfaces, as the particular device in the system and choice provides. For example, a text-to-speech process or a wave file play process is within the scope of the term "interface".

Figure 2:
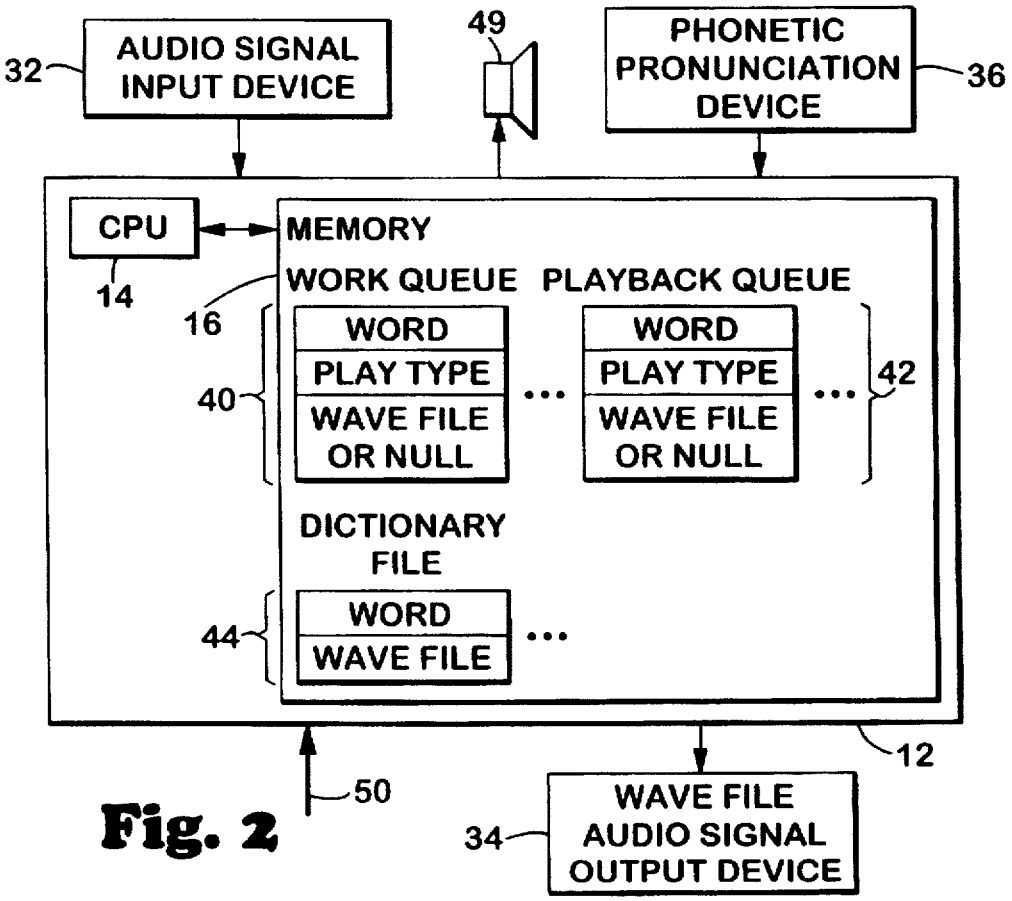
FIG. 2 depicts more detail of a processor for carrying out the present invention.

FIG. 2 depicts an architectural schematic of the processor 12 and, in particular, the various memory units that may be used to carry out the present invention. As previously described, the processor 12 includes a CPU 14 and a memory 16. Some of the memory is allotted to retaining certain data for purposes of this invention, as described below in greater detail.

An important aspect of the present invention includes the use of a work queue 40 and a playback queue 42. The work queue 40 ensures a certain amount of work for continuous and simultaneous work for processing, as later described. The playback queue 42 facilitates playback of a predetermined number of words to assist the user in dictionary update processing of a dictionary file 44.

Within each of the work queue 40 and the playback queue 42 is a field referred to as PLAY TYPE and a field referred to as WAVE FILE OR NULL. These fields define whether audible play of the word is to be made on the phonetic pronunciation device 36 (for a word string or text file) or a wave file play device 34 for a wave file, since a wave file is already in condition to be sounded. This feature is included so that the present invention is easily adapted to existing systems, and is an important feature of the present invention.

As shown in FIG. 2, the apparatus of the present invention also calls for the audio signal input device 32. The apparatus also includes the phonetic pronunciation device 36. Both the audio signal input device 32 and the phonetic pronunciation device 36 are well known in the art.

The system of the present invention also includes an interface adapter, shown generally as an input bus 50, to permit communication of the processor 12 with other devices, such as the communications port 30 or the mouse 24, for example, to receive and process text files and user specified commands. A multiplicity of input buses 50 should be understood as being optionally represented by input bus 50, the number of which corresponds to the number of attached devices.

Figure 3:
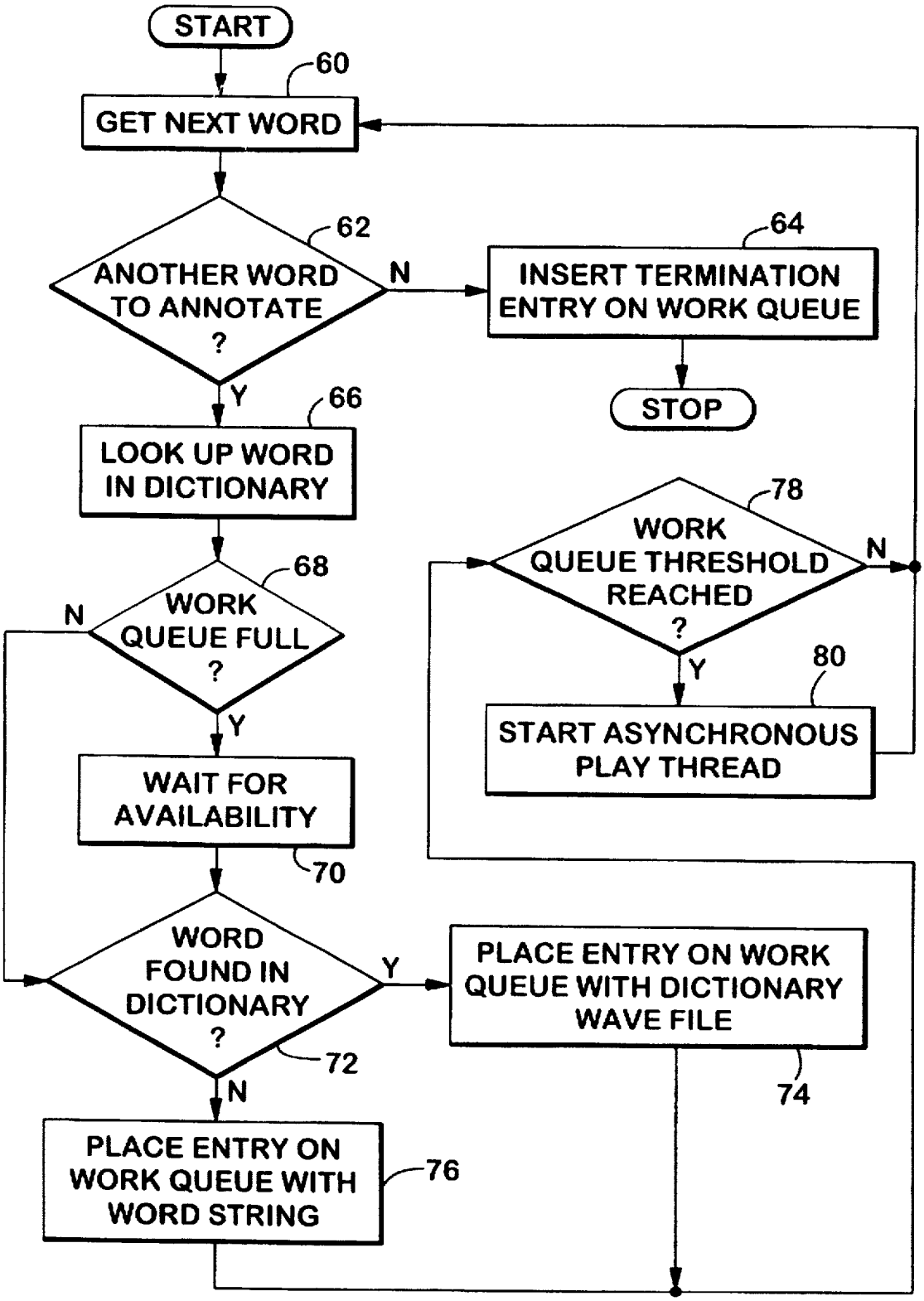
FIG. 3 is a logic flow diagram of the method of developing a work queue in the present invention.
Figure 4:
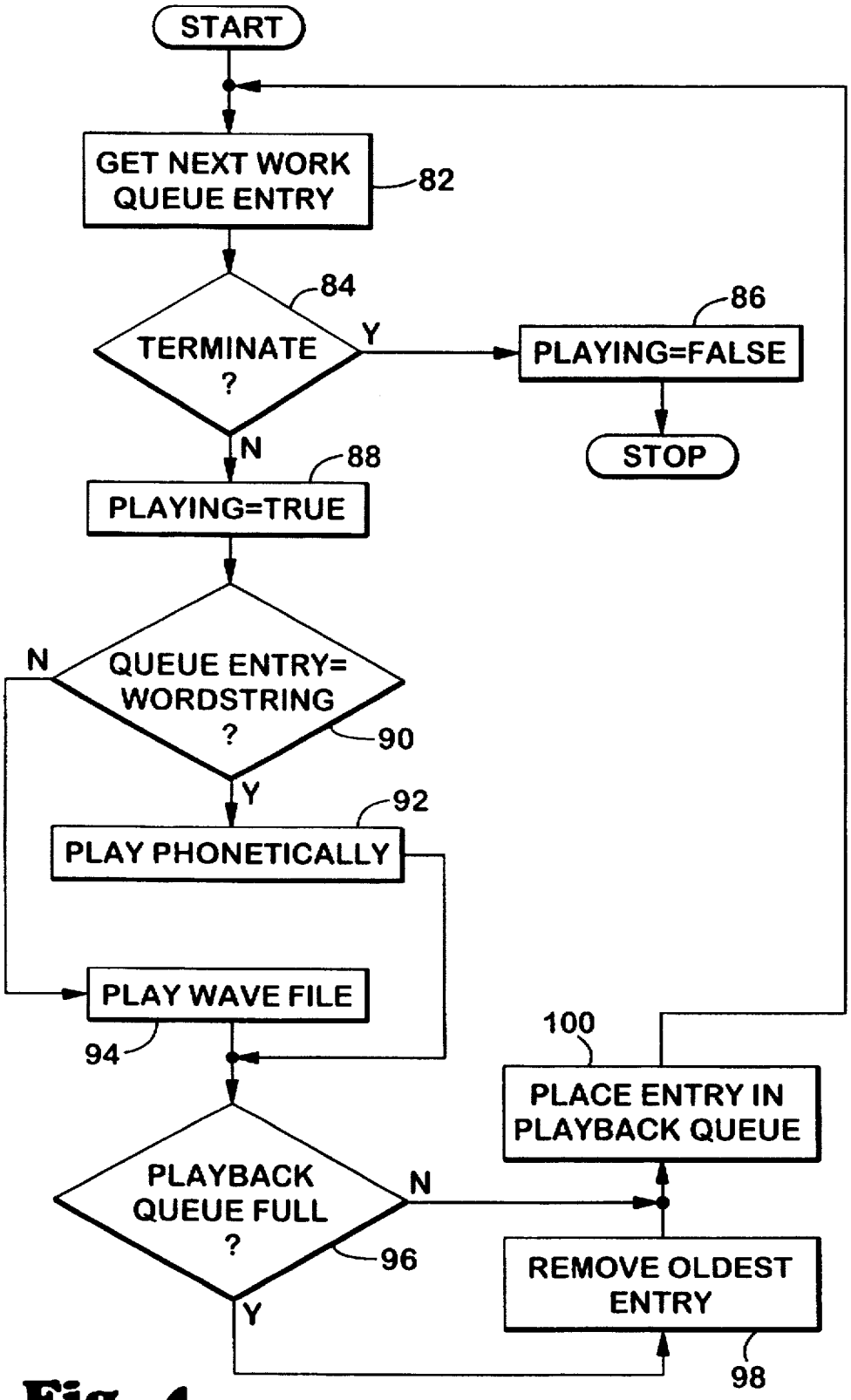
FIG. 4 is a logic flow diagram of the method of developing a playback queue in the present invention.
Figure 5:
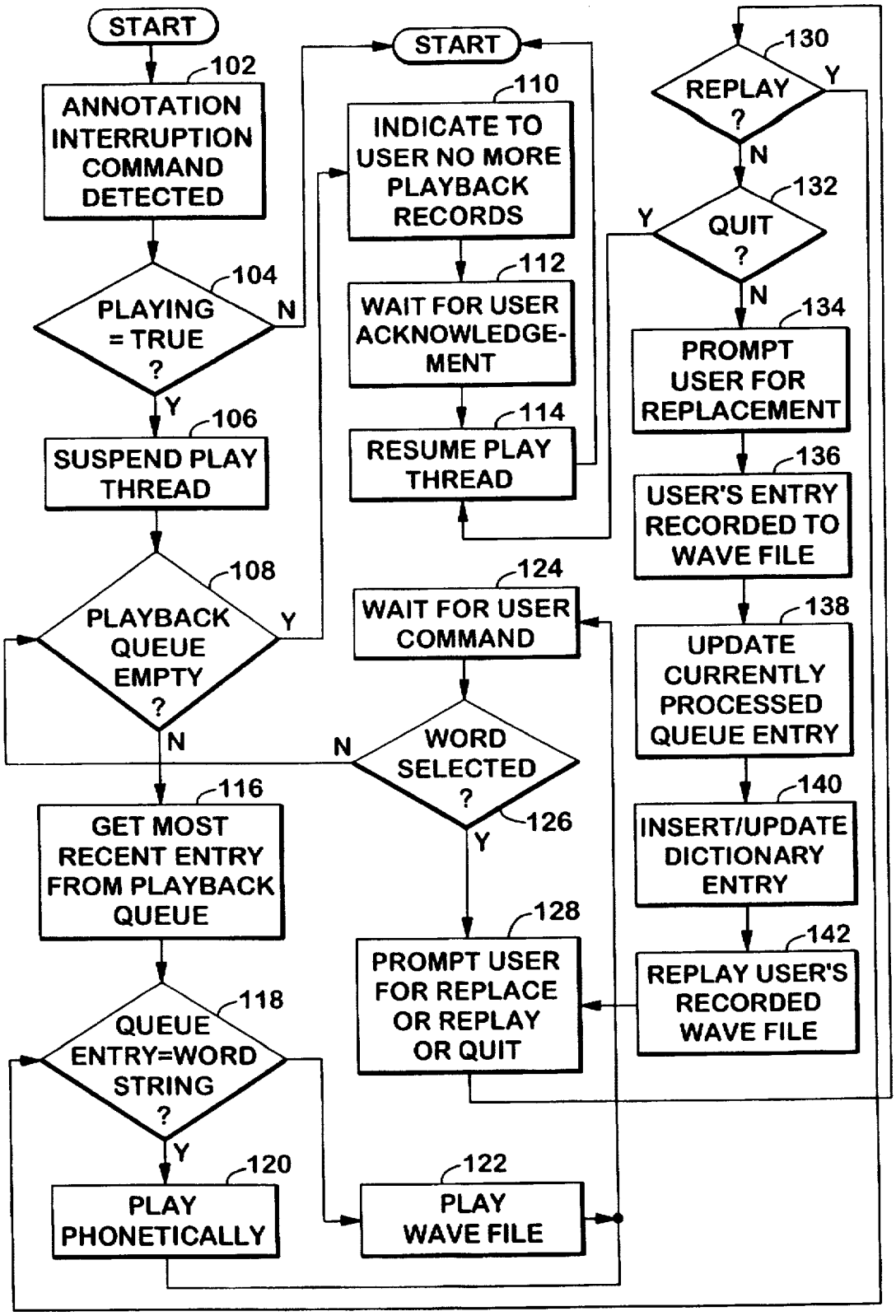
FIG. 5 is a logic flow diagram of the method of annotating a phonetically sounded entry, as well as updating the overriding dictionary of the present invention.

Overview of FIGS. 3, 4, and 5

Referring now to FIG. 3, a preferred logic flow diagram of the method of developing the work queue 40 is depicted. A user is provided with some text from a source such as on a screen that may be captured for processing or from a text file.

After the words to be processed have been identified, FIG. 3 begins the process. The process of FIG. 3 places entries on the work queue so that, during the play thread of FIG. 4, a backlog of work in process is available. That way, the audible play of words in the play thread is smooth and uninterrupted since the play thread need not wait for the next word to enunciate. As soon as the play thread is done playing a word, it can immediately have the next queue entry ready for play; otherwise, significant pauses between words will be introduced. Thus, the present invention is preferably embodied in a multi-tasking system such as OS/2 or UNIX.

The flow chart of FIG. 4 removes entries off the work queue in a first-in-first-out (FIFO) order and plays them sequentially. This play thread immediately retrieves the next entry from the work queue as soon as it has completed playing the previous entry. The logic flows of FIG. 3 and 4 preferably operate independently and asynchronously so that, certain functions such as dictionary searches and some other processing that may slow down the retrieval in processing of the next words, do not introduce gaps between pronunciations. The term "thread" is a term known in the art and is characterized by a separate, asynchronous process of execution.

The logic flow diagram of FIG. 5 demonstrates a preferred method of updating and revising the dictionary file 44. If, during the play thread, unsatisfactory phonetic pronunciation of a text file is encountered, the process of FIG. 5 provides an interrupt capability. Once the play thread is interrupted, the user can then offer his own preferred pronunciation of the word encountered. Once the dictionary has been updated, the system will recognize that word the next time it is encountered and provide the preferred pronunciation.

Detailed Description of FIGS. 3, 4, and 5

FIG. 3 begins with a START block in the conventional fashion. Step 60 selects the next word from the file to be processed, regardless of the textual source. Next, step 62 checks to see if another word remains to be processed. If no words remain to be processed, the system inserts a termination entry on the work queue in step 64 and then stops.

If a word remains to be processed, as determined by the decision step 62, the system will check to see if the word may be found in the dictionary in step 66. Next, a determination is made in step 68 if the work queue is full. If so, a pause is introduced in step 70 for availability of space in the work queue. Once space is available in the work queue, the system checks to see if the current word was found in the dictionary.

These steps illustrate a feature of the present invention. The process of placing entries on the work queue works independently of the play thread of FIG. 4. In this way, there will always be entries available to the play thread and no pauses are introduced in the playback function while the play thread awaits work. The data processing steps of extracting words from the textual source and searching the dictionary operates many times faster than the playback process, thus the playback will be smooth and continuous.

If a word was found in the dictionary, it is placed on the work queue in step 74 with the associated wave file. It should be noted that the dictionary retains word pronunciations as wave files, and step 74 simply extracts this wave file from the dictionary and places it on the work queue. If the word in not found in the dictionary, the word string itself is then placed in the work queue in step 76.

Once the current word has been placed on the work queue, step 78 checks to see if a user definable threshold on the work queue has been reached. The work queue threshold is another feature of the present invention. Having a minimum amount of work in the work queue helps to ensure that the play thread of FIG. 4 does not have to wait for entries from the work queue. The work queue will be sufficiently full. This helps to eliminate gaps between words during the playback process. If the work queue threshold has been reached, the asynchronous play thread of FIG. 4 is started in block 80. The method then returns to step 60 to extract the next word to be processed. It will be apparent to those of skill in the art that the process of FIG. 3 of extracting words to be processed will continue until the file is complete, even as the process of FIG. 4 has or has not yet been started.

Referring now to FIG. 4, the play thread as previously described is depicted. Step 82 removes the next entry off the work queue in FIFO order. Step 84 then checks to see if this next entry is a termination entry (FIG. 3, step 64). If the next entry indicates "terminate", step 86 sets a global flag "playing" equal to "false" and stops the play thread. If it is not a terminate entry, this indicates that the work queue has a valid word entry to process. Step 88 then sets the global flag "playing" equal to "true" to continue the play thread.

A determination must next be made as to how the current entry is to be played. This is another feature of the present invention. If step 90 determines that the next entry is a word string, it is played phonetically in step 92. If it is not a word string, it must be a wave file and is therefore played as such in step 94. This may or may not be on the same device.

Once a work queue entry has been played, it is then placed on the playback queue, but there must be room on the playback queue to receive the entry. Thus, step 96 determines if the playback queue is full. If the playback queue is full, step 98 clears the oldest entry in the queue, and then step 100 places the current entry onto the playback queue 42. If the playback queue is not full, step 100 proceeds as described. This feature of the present invention guarantees that a user can back up and listen to previously played entries, up to the maximum capacity of the playback queue, for example ten entries. The process then returns to step 82 to retrieve the next work queue entry.

Another feature of the present invention is the capability of suspending the play thread. For example, a user enters a command that stops the play thread because he wants to update the dictionary file 44. Such a command may be entered by any appropriate means, such as an oral command, a keyboard, a mouse, etc. For example, the user may wish to stop the play process because of a mispronunciation of a phonetically pronounced word string. The play thread should not be suspendable during steps 92, 94, or 96, because the process has already directed the playing of the current entry, and the process will automatically go ahead and place the current entry on the playback queue. It is therefore preferable to protect the unit of work starting at block 90 and ending at block 82 such that it is an uninterruptable unit of work. Should a suspension request occur during this unit of work, suspension will occur when encountering step 82 prior to execution of step 82.

The flowchart of FIG. 5 represents a preferred process of updating the overriding dictionary. Step 102 has detected an interruption command. In a preferred embodiment, the interruption command is a voice command. This may be done in a manner known in the art by recording a voice command and assigning a keyboard macro that automatically gets entered into the keyboard.

If the play thread is not running (see step 88) as determined in step 104, the variable PLAYING will not be equal to true and the process simply stops. Step 106 will then suspend the play thread adhering to suspension rules as previously described. Step 108 will then check the playback queue for entries. If the playback queue is empty, the process provides an appropriate indication to the user in step 110, waits for an acknowledgment in step 112, and, once the user has acknowledged the empty playback queue, resumes the play thread in step 114.

If the playback queue is not empty, the process extracts the most recent entry from the playback queue in step 116. Step 118 then determines if the selection is a word string or a wave file. Step 120 plays a word string phonetically, while step 122 simply plays the wave file. The process, in step 124, provides the user time to think about whether or not to change the current entry by selecting the word in step 126. If the user does not select the word, perhaps the system needs to go further back on the playback queue. So, the process returns to step 108 to check for entries on the playback queue.

If the user selected the word in step 126, step 128 prompts the user to select one of the options to either replay the word to assist in formulating a pronunciation, replace the word with a new pronunciation, or to quit. If the user decides to replay the word, step 130 returns the process to step 118 to identify the specific play type and then plays the word in either of steps 120 or 122, as before. If the user instead elected to quit, the process in step 132 continues the play thread in step 114, as before.

If the user did not choose to quit, then the process prompts the user in step 134 for the replacement recording. The replacement recording is recorded in step 136 to a wave file, and this wave file is then used in step 138 to update the currently identified queue entry. So that this new wave is available the next time the word comes up, step 140 also places the wave file in the dictionary as an entry for override of all future encounters of the text. Finally, step 142 replays this new entry to verify that is what the user intended. The process continues with step 128, as previously described.

The dictionary can be customized to suit a specific application. Furthermore, once a wave file entry has been made in the dictionary, known systems can access the dictionary entry and modify the file. For example, the volume (i.e., amplitude), frequency, or the like can be easily modified at the user's discretion. The dictionary file 44 (see FIG. 2) includes at least two fields, the text string and a fully qualified path name of the wave file. Thus, the entry in the wave file can be easily manipulated, using known tools and techniques, to develop a different sounding speech pattern, for example.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A voice enunciation system in a data processing system comprising:

a. a processor comprising a central processing unit and memory;

b. an audio signal output device;

c. the processor memory further comprising i. a work queue for receiving text words for processing;

ii. a playback queue for receiving text words from the work queue for audibly pronouncing the text words on the audio signal output device, and iii. a dictionary for storing preferred pronunciations of words; and d. the processor further providing means for i. storing text words in a memory;

ii. sequentially extracting text words from the memory;

iii. attempting to look up each of the sequentially extracted words in a dictionary and if a word is found in the dictionary, placing that word on a work queue as a wave file entry, and if the word is not found in the dictionary, placing that word on the work queue as a word string entry;

iv. continuing to place words on the work queue until a predetermined threshold number of words have been placed on the work queue;

v. when the predetermined threshold number of words have been placed on the work queues starting an asynchronous play thread, the asynchronous play thread comprising (a) extracting an entry from the work queue;

(b) determining if the entry is a wave file entry or a word string entry;

(c) if the entry is a wave file entry, audibly playing the wave file, and (d) if the entry is a word string audibly playing the word string phonetically;

vi. once an entry has been audibly played, placing that entry on a playback queue until the playback queue is full; and vii. once the playback queue is full, deleting the oldest entry from the playback queue.

2. The voice enunciation system of claim 1 wherein the receipt of text data for processing by the work queue is asynchronous with the receipt of text data by the playback queue.

3. The voice enunciation system of claim 2 further comprising means for providing uninterrupted receipt of text data by the playback queue from the work queue.

4. The voice enunciation system of claim 1 further comprising means for selectively storing preferred pronunciations in the dictionary.

5. A voice enunciation method comprising the steps of:

a. storing text words in a memory;

b. sequentially extracting text words from the memory;

c. attempting to look up each of the sequentially extracted words in a dictionary and if a word is found in the dictionary, placing that word on a work queue as a wave file entry, and if the word is not found in the dictionary, placing that word on the work queue as a word string entry;

d. continuing to place words on the work queue until a predetermined threshold number of words have been placed on the work queue;

e. when the predetermined threshold number of words have been placed on the work queue, starting an asynchronous play thread, the asynchronous play thread comprising i. extracting an entry from the work queue;

ii. determining if the entry is a wave file entry or a word string entry;

iii. if the entry is a wave file entry, audibly playing the wave file: and iv. if the entry is a word string audibly playing(l the word string phonetically;

f. once an entry has been audibly played, placing that entry on a playback queue until the playback queue is full; and g. once the playback queue is full, deleting the oldest entry from the playback queue.

6. The method of claim 5, further comprising the steps of:

a. continuing to place words on the work queue until the work queue is full; and b. when the work queue is full, waiting until memory space is available on the work queue.

7. The method of claim 5 further comprising the step of interrupting the audible playing of words from the work queue.

8. The method of claim 7 further comprising the step of audibly playing words from the playback queue in last-in-first out order.

9. The method of claim 8 further comprising the step of replacing an entry in the playback queue.

10. The method of claim 8 further comprising the step of updating the dictionary with a user selectable wave file.

11. A method in a data processing system for enhancing voice pronunciation of a textual input stream comprising the steps of:

receiving text from the textual input stream;

customizing a customizable pronunciation dictionary by a user immediately upon recognition by the user that one or more textual portions from the textual input stream was mispronounced the customizing step further comprising invoking a process interruption by a user during processing of the textual input stream, automatically suspending the process before completing processing of the textual input stream, and presenting an appropriate interface for selecting and editing the textual portions for proper pronunciations;

comparing the text with the customizable pronunciation dictionary;

determining a sound interface input in accordance with one of a plurality of playing methods for playing sound associated with the text; and routing the sound interface input to an appropriate device interface in accordance with the one of a plurality of playing methods.

12. The method of claim 11, wherein the step of determining a sound interface input further comprises the steps of:

receiving a found status or a not found status upon search of the text with the customizable pronunciation dictionary;

preparing the text for a first interface which will play sound according to the text provided as input to the first interface when the status is a not found status; and preparing a wave file associated with the text for a second interface which will play sound according to the wave file provided as input to the second interface and which corresponds to the text matched in the customizable pronunciation dictionary when the status is a found status.

13. The method of claim 11 wherein routing the sound interface input to an appropriate device interface comprises routing the input to a text-to-speech process.

14. The method of claim 11 wherein routing the sound interface input to an appropriate device interface comprises routing the input to a wave file play process.

15. The method of claim 14 wherein the step of invoking an interruption is carried out through a voice command.

16. The method of claim 14 wherein proper pronunciations are saved into the customizable pronunciation dictionary.

17. The method of claim 14 wherein the customizable pronunciation dictionary comprises one or more records, each record containing at least two fields, the at least two fields comprising a textual string field and an associated wave file field for sound associated with the textual string.

18. The method of claim 11 wherein the step of presenting an appropriate interface permits playback of a previously defined number of entries.

19. Apparatus for enhancing voice pronunciation of a textual input stream in a data processing system comprising:

means for receiving text from the textual input stream;

means for comparing the text with a customizable pronunciation dictionary, the customizable pronunciation dictionary including means for customizing the pronunciation dictionary by a user immediately upon recognition by the user that one or more textual portions from the textual input stream was mispronounced, wherein the means for customizing further comprises means for invoking a process interruption by a user during processing of the textual input stream.

means for automatically suspending the process before completing processing of the textual input stream, and means for presenting an appropriate interface for selecting and editing the textual portions for proper pronunciations;

means for determining a sound interface input in accordance with one of a plurality of playing methods for playing sound associated with the text; and means for routing the sound interface input to an appropriate device interface in accordance with the one of a plurality of playing methods.

20. The apparatus of claim 19, wherein the means for determining a sound interface input further comprises:

means for receiving a found status or a not found status upon search of the text with the customizable dictionary;

means for preparing the text for a first interface which will play sound according to the text provided as input to the first interface when the status is a not found status; and means for preparing a wave file associated with the text for a second interface which will play sound according to the wave file provided as input to the second interface and which corresponds to the text matched in the customizable dictionary when the status is a found status.

21. The apparatus of claim 19 wherein the means for routing the sound interface input to an appropriate device interface comprises a means for routing the input to a text-to-speech process.

22. The apparatus of claim 19 wherein the means for routing the sound interface input to an appropriate device interface comprises a means for routing the input to a wave file play process.

23. The apparatus of claim 19 wherein the means for invoking an interruption is actuated through a voice command.

24. The apparatus of claim 19 further comprising means for saving proper pronunciations into the customizable dictionary.

25. The apparatus of claim 19 wherein the customizable pronunciation dictionary comprises one or more records, each record containing at least two fields, the at least two fields comprising a textual string field and an associated wave file field for sound associated with the textual string.

26. The apparatus of claim 19 wherein the means for presenting an appropriate interface permits playback of a previously defined number of entries.

* * * * *